US006904251B2

(12) United States Patent
Uyama et al.

(10) Patent No.: US 6,904,251 B2
(45) Date of Patent: Jun. 7, 2005

(54) IMAGE FORMING APPARATUS INCLUDING A TRANSFER MEMBER MADE OF A RESIN MATERIAL FOR USE WITH TONER HAVING A SPECIFIED WEIGHT PARTICLE SIZE DISTRIBUTION

(75) Inventors: Masao Uyama, Shizuoka (JP); Masahide Kinoshita, Shizuoka (JP); Kenichi Iida, Boise, ID (US)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/693,860

(22) Filed: Oct. 28, 2003

(65) Prior Publication Data

US 2004/0161262 A1 Aug. 19, 2004

(30) Foreign Application Priority Data

Oct. 31, 2002 (JP) ..... 2002-318876

(51) Int. Cl.[7] ..... G03G 15/08
(52) U.S. Cl. ..... 399/149; 430/110.4
(58) Field of Search ..... 399/149, 252, 399/302, 308, 150; 430/108.7, 110.1, 110.4

(56) References Cited

U.S. PATENT DOCUMENTS 5,483,327 A * 1/1996 Taya et al. ..... 399/223
6,115,575 A 9/2000 Kinoshita et al. ..... 399/286
6,505,021 B2 * 1/2003 Shibuya et al. ..... 399/149

FOREIGN PATENT DOCUMENTS

JP 2000-352845 12/2000

* cited by examiner

*Primary Examiner*—Quana Grainger
(74) *Attorney, Agent, or Firm*—Fitzpatrick, Cella, Harper & Scinto

(57) ABSTRACT

The image forming apparatus includes: a plurality of image forming units each having an image bearing member and a developing unit; and a transfer member provided to be able to contact the plurality of image bearing members. The toner used in at least one of the plurality of developing units contains a toner particle group with a particle size of 12.7 $\mu$m or more, a ratio of the toner particle group to the entire toner being 1.0% or less. Accordingly, incomplete transfer can be prevented.

17 Claims, 3 Drawing Sheets

IMAGE FORMING APPARATUS INCLUDING A TRANSFER MEMBER MADE OF A RESIN MATERIAL FOR USE WITH TONER HAVING A SPECIFIED WEIGHT PARTICLE SIZE DISTRIBUTION

BACKGROUND OF THE INVENTION

1. Field of the Invention

The present invention relates to an image forming apparatus for developing an electrostatic image formed on an image bearing member by use of a developer and recording the developed image on a transfer material, for example, a copying machine, a page printer, a facsimile, or the like.

2. Related Background Art

Up to now, an image forming apparatus adopting an electrophotographic process, such as a copying machine, a printer, or a facsimile, includes an electrophotographic photosensitive member (photosensitive member) that serves as an image bearing member and generally has a rotating drum shape, a charging apparatus (charging step) for uniformly charging the photosensitive member to a predetermined polarity/potential, an exposure apparatus (exposure step) serving as information writing means for forming an electrostatic latent image on the charged photosensitive member, a developing apparatus (developing step) for visualizing the electrostatic latent image formed on the photosensitive member as a developer image (toner image) by use of toner serving as a developer, a transfer apparatus (transfer step) for transferring the toner image from a surface of the photosensitive member onto a transfer material such as a paper, a cleaning apparatus (cleaning step) for removing the developer remaining to a certain degree on the surface of the photosensitive member that has undergone the transfer step (residual toner or transfer residual toner) to clean the surface of the photosensitive member, a fixing apparatus (fixing step) for fixing the toner image on the transfer material. The photosensitive member is repeatedly subjected to the electrophotographic process (including charging, exposure, developing, transfer, and cleaning) to form images.

In general, provided inside the cleaning apparatus is a waste toner collecting container for receiving the transfer residual toner removed from the surface of the photosensitive member by the cleaning apparatus. Therefore, in order to obtain the image forming apparatus with a long life, it is necessary to increase a size of the waste toner collecting container, which is a disadvantage in reducing the size of the image forming apparatus.

In view of the above, an image forming apparatus of a cleanerless system has been proposed which is structured such that, without using the cleaning apparatus having the waste toner collecting container, the transfer residual toner on the photosensitive member that has undergone the transfer step can be removed and collected from the photosensitive member to be reused in the developing apparatus by means of cleaning simultaneous with developing for simultaneously performing a developing operation and a cleaning operation.

In the cleanerless system, when the transfer residual toner on the photosensitive member that has undergone the transfer step is reused in the subsequent developing steps, that is, when developing another electrostatic latent image after the photosensitive member is again charged and exposed to form the electrostatic latent image, the transfer residual toner existing in a portion (unexposed portion or non-image portion) on the photosensitive member which is not to be developed can be collected in the developing apparatus by application of a fog removing bias (a fog removing potential difference Vback which is a potential difference between a DC voltage applied to the developing apparatus and a surface potential of the photosensitive member).

According to the above method, the transfer residual toner is collected in the developing apparatus and reused to develop electrostatic latent images in the subsequent developing steps. Therefore, the residual toner can be eliminated, and inconvenience of maintenance can also be reduced. In addition, the image forming apparatus of the cleanerless system is advantageous in reducing its size.

In recent years, particularly in an image forming apparatus capable of forming an image in color (chromatic color), there has been widespread demand for an ability to output an image at high speed and a compatibility with various kinds of transfer papers (media). To meet the demand, an image forming apparatus of a four-drum system (an in-line system) and of an intermediate transferring member system has been devised, which includes a plurality of image forming sections each having a photosensitive member serving as a first image bearing member, and temporarily multiple-transfers toner images formed on the respective photosensitive members onto an intermediate transferring member (a transfer member) serving as a second image bearing member in a continuous manner to obtain, for example, a full color print image.

However, the following problem occurs in an image forming apparatus that adopts the cleanerless system in terms of a long life and a small-sized apparatus, the intermediate transferring member system in terms of a compatibility with various kinds of media, and the in-line system in terms of an ability to output an image at high speed.

That is, in the structure adopting the in-line system, the cleanerless system, and the intermediate transferring member system, there may occur a problem of color mixture for toner in the case of forming a color image, which will be described in detail below.

In a first image forming section, a yellow image is formed on a first photosensitive member, and in a second image forming section, a magenta image is formed on a second photosensitive member. Then, a yellow toner image and a magenta toner image are sequentially transferred onto the intermediate transferring member as the transfer member by respective transfer means opposed to the first photosensitive member and the second photosensitive member.

In this case, while the yellow toner image transferred from the first image forming section onto the intermediate transferring member is passing a position of the transfer means of the second image forming section, part of yellow toner may be transferred to the second photosensitive member, which is so-called retransfer.

This retransfer phenomenon depends on conditions such as surface properties and a surface potential of the photosensitive member, a charge amount and a specific charge of the toner, and the structure and the transfer bias of the transfer means. If those conditions can be appropriately adjusted, the probability of occurrence of the retransfer may conceivably become almost 0%. However, it is practically difficult to eliminate the retransfer phenomenon completely.

If the retransfer phenomenon occurs, in the cleanerless system, the toner of the image forming section on an upstream side in a moving direction of the intermediate transferring member is mixed into a developing device of the image forming section on a downstream side. Then, if a contamination amount of the toner becomes larger, the color tint of the image is varied due to the color mixture.

In view of the above, in the structure adopting the in-line system, the cleanerless system, and the intermediate transferring member system, a transferring current value of the transfer means for transferring and fixing the toner on the photosensitive member onto the intermediate transferring member is set to a lower value than in a structure conventionally used in general which includes blade-shaped cleaning means (a cleaning blade) for scraping toner off while being in abutment with the photosensitive member (hereinafter, referred to as cleaning blade structure). Thus, the color mixture due to the retransfer is suppressed to the minimum.

FIG. 3 shows an example of a correlation of the transferring current value with a transferring efficiency and a retransferring efficiency (this shows a case where a longitudinal length of an operation part with respect to an intermediate transferring member of primary transfer means is 330 mm). As can be seen from FIG. 3, the retransferring efficiency maintains an almost constant value up to Ib indicated in a graph of FIG. 3 according to the increase in the transferring current value of the transfer means, and shows a tendency of increasing after Ib. On the other hand, the transferring efficiency shows a tendency of increasing up to Ia indicated in the graph of FIG. 3, and shows a tendency of decreasing after Ia.

Therefore, in the case of the cleaning blade structure, the transferring current value is normally set to a value between Ib and Ia of FIG. 3, for example, approximately 14 $\mu$A. In the cleaning blade structure, the retransferred toner is collected by the cleaning blade, so that the problem of color mixture does not occur. On the other hand, in the cleanerless system, it is necessary to suppress the probability of occurrence of the retransfer to almost 0% as described above. Therefore, the transferring current value is normally set to a value that is equal to or lower than Ib of FIG. 3 and as high in transferring efficiency as possible, for example, approximately 8 $\mu$A. That is, as is apparent from FIG. 3, the conditions are set such that the transferring efficiency is slightly lower (worse).

Further, if the conventional toner is used to output images continuously, there is a case where the toner electrostatically coheres by a small amount. This is because in accordance with the continuous image output, a triboelectrification charge of a negative polarity (negative triboelectricity) amount of toner with a small particle size becomes larger while a small amount of toner with a large particle size tends to exert a triboelectrification charge of a positive polarity (positive triboelectricity), thereby causing the toner with a small particle size and the toner with a large particle size to electrostatically cohere.

In the image forming apparatus using the intermediate transferring member made of, for example, a resin, if the toner electrostatically cohere as described above, due to the hard intermediate transferring member made of a resin, a gap will develop between the photosensitive member and the intermediate transferring member. As a result, transferring properties are deteriorated.

In the case where the transferring properties are thus deteriorated, even if the transferring current value set for the cleaning blade structure exerts no adverse effect on the transferring properties, the transferring current value set for the cleanerless system may cause a problem of incomplete transfer.

SUMMARY OF THE INVENTION

It is an object of the present invention to provide an image forming apparatus which prevents untransfer.

It is another object of the present invention to provide an image forming apparatus in which toner contains a reduced proportion of a toner particle group with a large particle size.

It is another object of the present invention to provide an image forming apparatus which prevents incomplete transfer due to electrostatic cohesion of toner, and is capable of forming a high quality image.

It is another object of the present invention to provide an image forming apparatus which prevents a problem of incomplete transfer caused by electrostatic cohesion of toner, and is capable of minimizing variation in color tint due to retransfer.

It is another object of the present invention to provide an image forming apparatus which collects residual toner on an image bearing member using a developing device, and in which toner contained in the developing device is controlled so as not to contain a toner particle group with a large particle size.

It is another object of the present invention to provide an image forming apparatus which suitably adopts an in-line system, a cleanerless system, and an intermediate transferring member system.

Further other objects, features, and advantages of the present invention will become more apparent upon reading the following detailed description with reference to the accompanying drawings.

DETAILED DESCRIPTION OF THE PREFERRED EMBODIMENT

Hereinafter, an image forming apparatus according to the present invention will be described in more detail with reference to the drawings.

Embodiment 1

Figure 1:
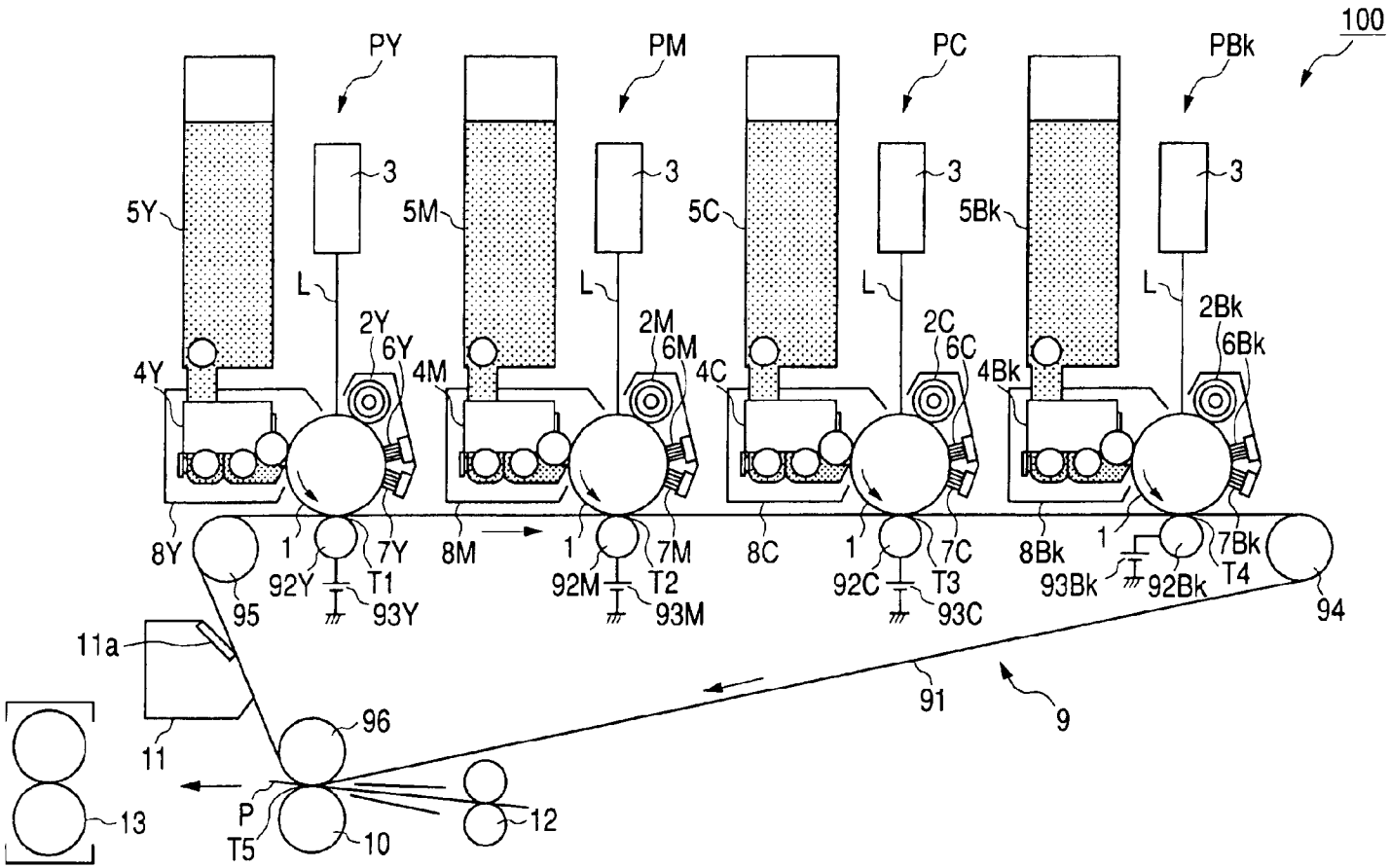
FIG. 1 is a schematic cross-sectional view of an example of an image forming apparatus to which the present invention can be applied.

FIG. 1 shows a schematic structure of one embodiment of the image forming apparatus according to the present invention. An image forming apparatus 100 of this embodiment is a color laser printer that adopts a transfer-system electrophotographic process, a contact charge system, and a reversal development system, and is capable of passing a paper of up to A3 size. The image forming apparatus 100 can form and output a full color image on a transfer material such as a paper, an OHP sheet, and a cloth according to image information from an external host apparatus that is connected to and communicates with an image forming apparatus main body (apparatus main body).

The image forming apparatus 100 is an image forming apparatus of four-drum system (in-line system) and includes a plurality of image forming means, that is, image forming sections PY, PM, PC, and PBk that form yellow (Y), magenta (M), cyan (C), and black (Bk) images, respectively. With the image forming apparatus 100, a full color print image can be obtained by first multiple-transferring toner images continuously onto an intermediate transferring belt 91 serving as a transfer member by process cartridges 8 provided to the respective image forming sections, and then collectively transferring the images onto a transfer material P. The process cartridges 8 are provided for the four colors, yellow, magenta, cyan, and black, and are arranged serially in this order in the moving direction of the intermediate transferring belt 91.

In this embodiment, the structures of the image forming sections PY, PM, PC, and PBk are the same except that the color of the developer used for each section is different. Accordingly, the suffixes Y, M, C, and Bk added to the symbols indicating components of the image forming sections are omitted and description is made representatively, unless it is necessary to make distinction among the four image forming sections.

The entire operation for forming a full color image of the four colors is described, for example. Color-separated image signals are generated according to signals from the external host apparatus that is connected to and communicates with the image forming apparatus 100. Toner images of each color are formed, according to the image signals, in the respective process cartridges 8Y, 8M, 8C, and 8Bk of the image forming sections PY, PM, PC, and PBk. In each of the process cartridges 8Y, 8M, 8C, and 8Bk, an electrophotographic photosensitive member (photosensitive drum) 1 serving as an image bearing member is charged by a charging roller 2 as charging means, and the uniformly charged surface of the photosensitive drum 1 is scanned and exposed by laser beam scanner 3 as exposure means to form an electrostatic latent image thereon. The electrostatic latent image is provided with toner as a developer by developing device 4 as developing means, and the toner image is formed. The toner images of each color, which are each formed on the photosensitive drum 1, are transferred sequentially onto the intermediate transferring belt 91 serving as a moving intermediate transferring member (second image bearing member) with one image on top of another. A full color toner image formed on the intermediate transferring belt 91 is then collectively transferred onto the transfer material P that has been conveyed to a secondary transfer part where the intermediate transferring belt 91 and a secondary transfer roller 10 serving as secondary transfer means are placed facing each other. Then, the transfer material P is conveyed to fixing means 13 where the toner image is fixed, and is delivered to the outside of the apparatus.

Hereinafter, components of the image forming apparatus 100 are sequentially described in more detail with reference to FIG. 2 as well.

The image forming apparatus 100 includes the electrophotographic photosensitive member (photosensitive drum) 1 of rotary drum type as an image bearing member. In this embodiment, the photosensitive drum 1 is an organic photoconductor (OPC) drum with an external diameter of 30 mm, which is driven to rotate counterclockwise (as shown by an arrow in FIG. 2) at a processing speed (peripheral velocity) of 117 mm/sec around a central spindle. The photosensitive drum 1 is 370 mm long in the longitudinal direction, and is structured by coating the surface of an aluminum cylinder (conductive drum body) with three layers, a base layer that suppresses interference of light and improves adhesion properties of the layers above, a photocharge generating layer, and a charge transporting layer (20 μm thick), which are stacked in this order. The width of the coating where contact charging process is possible is set to 340 mm.

In this embodiment, the image forming apparatus 100 includes a charging roller 2 as charging means, which is a contact charging device that contacts the image bearing member. The photosensitive drum 1 is uniformly charged into a negative polarity by applying a voltage of a predetermined condition to the charging roller 2. The charging roller 2 is structured by forming around a metal core (support member) 2*a* three layers, a lower layer 2*b*, a middle layer 2*c*, and a surface layer 2*d*, which are stacked in this order. The lower layer 2*b* is a foamed sponge layer for reducing noise during charging, the middle layer 2*c* is a resistance layer for giving a uniform resistance to the entire charging roller 2, and the surface layer 2*d* is a protective layer for preventing a leak from occurring even if there is a pinhole or other defects on the photosensitive drum 1. In this embodiment, the metal core 2*a* of the charging roller 2 is a stainless round bar 6 mm in diameter, and the surface layer 2*d* is made of a fluororesin with carbons dispersed thereon. The external diameter of the charging roller 2 is 14 mm, the roller resistance is set to $10^4$ Ω to $10^7$ Ω, and the length in the longitudinal direction (width of charging) is 320 mm.

The charging roller 2 is pressed against the surface of the photosensitive drum 1 by a predetermined pressure with both end portions of the metal core 2*a* rotatably held by bearing members, and is biased by a pressure spring toward the photosensitive drum 1. The charging roller 2 rotates in accordance with the rotation of the photosensitive drum 1. A predetermined oscillation voltage (charging bias voltage Vdc+Vac), which is obtained by superposing a DC voltage and an AC voltage of a predetermined frequency, is applied to the charging roller 2 from a power source 20 serving as voltage applying means via the metal core 2*a*, charging the peripheral surface of the rotating photosensitive drum 1 to a predetermined potential. The contact portion of the charging roller 2 and the photosensitive drum 1 is a charging part a.

In this embodiment, the charging bias voltage that is applied to the charging roller 2 is an oscillation voltage that is obtained by superposing a −500 V DC voltage and a sinusoidal AC voltage with a frequency of 1150 Hz and a peak-to-peak voltage Vpp of 1400 V. The peripheral surface of the photosensitive drum 1 is uniformly charged at −500 V (voltage of dark portion Vd) by the contact charging process.

Further, a charging roller cleaning member 2*f* is provided to the charging roller 2. In this embodiment, the charging roller cleaning member 2*f* is a flexible cleaning film set to a length of 330 mm in the longitudinal direction. The cleaning film 2*f* is placed in parallel with the charging roller 2 in the longitudinal direction. An end of the cleaning film 2*f* is fixed by a support member 2*g* that reciprocates by a given amount in the longitudinal direction of the charging roller 2. A contact nip is formed between the charging roller 2 and the surface of the cleaning film 2*f* in the vicinity of a free end. In this embodiment, the support member 2*g* reciprocates in a range of 6 mm. A drive motor of the image forming apparatus 100 causes the support member 2*g* to reciprocate a given amount in the longitudinal direction of the charging roller 2, via a gear train, which causes the cleaning film 2*f* to rub the surface layer 2*d* of the charging roller. Thus the adhering contaminants (fine powder toner, extraneous additive, etc.) is removed from the surface layer 2*d* of the charging roller 2.

The photosensitive drum 1 is uniformly charged at a predetermined polarity and potential by the charging roller 2, and is subjected to image exposure using a laser light L by image exposing means (such as color separating/imaging exposure optical system, and scanning exposure optical system by laser scan that outputs laser beams modulated in accordance with a time-series electric digital pixel signal of image information). Electrostatic latent images are thus formed for the color components of the target color image, the color components corresponding to the image forming sections PY, PM, PC, and PBk, respectively. In this embodiment, a laser beam scanner 3 that includes a semiconductor laser is used as exposing means. The laser beam scanner 3 outputs a laser light that is modulated in accordance with an image signal sent from the host apparatus such as an image reading apparatus (not shown) to the image forming apparatus 100, and exposes by laser scanning (image exposure) the surface to be uniformly charged of the rotating photosensitive drum 1. By this laser scanning exposure, the potential of the portion on the surface of the photosensitive drum 1 where the laser light L has been irradiated drops, and the electrostatic latent image corresponding to the image information, which has been exposed by scanning, is formed on the rotating photosensitive drum 1. In this embodiment, the potential V1 of the exposed portion is −150 V. The portion of the photosensitive drum 1 where the laser light L for image exposure is irradiated is an exposure part b.

The electrostatic latent image formed on the photosensitive drum 1 is developed with toner at a developing device 4 serving as developing means. In this embodiment, the developing device 4 is a two-component contact developing device (two-component magnetic brush developing device). The developing device 4 includes a developer container (developing device main body) 40, a developing sleeve 41 that has a magnet roller fixed inside and serves as a developer bearing member, a developer regulating blade 42 serving as a developer regulating member, a two-component developer (developer) 46, and developer agitating members 43 and 44 that are disposed on the bottom portion inside the developer container 40. The developer 46 is a mixture mainly containing resin toner particles (toner) and magnetic carrier particles (carrier), and is accommodated in the developer container 40.

The developing sleeve 41 is rotatably arranged in the developer container 40 with part of its peripheral surface exposed to the outside of the developer container 40. The external diameter of the developing sleeve 41 is set to 16 mm, and the width of developing is set to 310 mm. In this embodiment, the developer regulating blade 42 and the developing sleeve 41 are arranged to face each other with a space of 250 $\mu$m therebetween. The developer regulating blade 42 serves to form a thin layer of developer on the developing sleeve 41 as the developing sleeve 41 rotates in the direction indicated by an arrow in FIG. 2. In this embodiment, the developing sleeve 41 and the photosensitive drum 1 are arranged close and faced with each other with the shortest distance of gap (S-Dgap) being 400 $\mu$m. The portion where the photosensitive drum 1 and the developing sleeve 41 face each other is a developing part c.

The developing sleeve 41 is driven to rotate in the opposite direction of the rotating direction of the photosensitive drum 1 at the developing part c. The peripheral speed of the developing sleeve 41 is 170% of the speed of the photosensitive drum 1. The thin layer of developer on the developing sleeve 41 contacts the surface of the photosensitive drum 1 at the developing part c and rubs the photosensitive drum 1 moderately. A predetermined developing bias voltage is applied from a power source (not shown) serving as voltage applying means to the developing sleeve 41. In this embodiment, the developing bias voltage applied to the developing sleeve 41 is an oscillation voltage that is obtained by superposing a DC voltage (Vdc) and an AC voltage (Vac). More specifically, the oscillation voltage is obtained by superposing a Vdc of −350 V and a Vac of 1800 Vpp with a frequency of 2300 Hz.

As mentioned above, the surface of the rotating developing sleeve 41 is coated with the thin layer of developer. The toner in the developer 46 is carried to the developing part c and selectively adheres to the photosensitive drum 1 corresponding to the electrostatic latent image formed thereon by an electric field of the developing bias voltage. The electrostatic latent image is thus developed as a toner image. In this embodiment, the toner adheres to the exposed light portion of the photosensitive drum 1 and the electrostatic image is reversal-developed. The thin layer of developer on the developing sleeve 41 returns to a developer reservoir inside the developer container 40 after passing the developing part c as the developing sleeve 41 continues to rotate.

Further, in the developing device 4, an agitating screw 43 and an agitating screw 44 as developer agitating members are provided. The agitating screw 43 and the agitating screw 44 rotate in synchronization with the rotation of the developing sleeve 41 and have functions of agitating and mixing the replenished toner and the carries to impart the predetermined triboelectrification charge to the toner. In addition, the agitating screw 43 and the agitating screw 44 feed the developer 46 in the opposite directions in the longitudinal direction, respectively. While feeding the developer 46 to the developing sleeve 41, the agitating screw 43 and the agitating screw 44 have functions of feeding the developer 46 the toner density (proportion of the toner in the developer) of which is reduced in the developing step to the toner replenishment part to circulate the developer 46 in the developing container 40.

The sensor 45 for detecting the toner density in the developer 46 by detecting the magnetic permeability change of the developer 46 is provided on the upstream-side wall surface of the agitating screw 44 of the developing device 4. The toner replenishment opening 47 is provided on the slightly downstream side of the toner density sensor 45 in the circulating direction of the developer 46. After the developing operation, the developer 46 is fed to the toner density sensor 45 where the toner density is detected. Based on the detection result, the toner is appropriately replenished from the toner replenishment unit 5 through the toner replenishment opening 47 of the developing device 4 in accordance with the rotation of the screw 51 provided in the developer replenishment container (toner replenishment unit) 5 connected to the developing device 4. The replenished toner is fed by the agitating screw 44 and mixed with the carriers, and imparted with the triboelectrification charge to a suitable degree. After that, the resultant toner is fed to the vicinities of the developing sleeve 41. The toner is formed in thin layers on the developing sleeve 41 to be used for the development.

The toner with the mean particle size of 5 $\mu$m to 10 $\mu$m can be preferably used as the toner mainly from the viewpoint of the transfer property and the image quality. More preferably, the toner with the mean particle size of 6 $\mu$m to 9 $\mu$m can be used. The toner with the mean particle size of 6.5 $\mu$m to 8.5 $\mu$m is most preferable for use. In this embodiment, used is the toner charged negatively with the mean particle size of 7 $\mu$m. As the carrier, a magnetic carrier having a saturation magnetization of 205 emu/cm$^3$ and a mean particle size of 35 $\mu$m is used. A developer in which the toner and the carrier are mixed in a weight ratio of 6:94 is used as the developer. Note that the charge amount of the toner used for the development on the photosensitive drum 1 is −25 $\mu$C/g.

An intermediate transfer unit 9 is provided so as to face each of the photosensitive drums 1 for the image forming sections PY, PM, PC, and PBk. In the intermediate transfer unit 9, an endless intermediate transferring belt 91 as the intermediate transferring member (second image bearing member) is stretched over a drive roller 94, a tension roller 95, and a secondary transfer opposing roller 96 with a predetermined tension and moves in the direction of the arrow in the figure.

The toner image formed on the photosensitive drum 1 comes into the primary transfer nip part (transfer part) d as a contact part between the photosensitive drum 1 and the intermediate transferring belt 91. At the transfer part d, the primary transfer roller 92 as the transfer means is lifted by means of springs for applying 500 gf which are provided at both ends thereof. The primary transfer roller 92 is brought into contact with the rear side of the intermediate transferring belt 91 with a force obtained by subtracting 150 g as a weight of the primary transfer roller 92 (its own weight) from the above value. The primary transfer roller 92 is formed of a conductive sponge member and its resistance is set to $10^6$ Ω or less. An external diameter thereof is set to 16 mm and a longitudinal length of the operation part with respect to the intermediate transferring belt 91 is set to 330 mm.

A primary transfer bias power source 93 as the voltage applying means is connected to the primary transfer roller 92 as the transfer means in order to enable the primary transfer bias voltage to be applied to the image forming sections PY, PM, PC, and PBk independently of each other. Onto the intermediate transferring belt 91, the yellow toner image formed on the photosensitive drum 1 with the above operation is first transferred in the image forming section PY for the first color (yellow) and then, the toner images of the respective colors are multiple-transferred in the order of magenta, cyan, and black, with the photosensitive drums 1 corresponding to the respective colors after the similar step, in the image forming sections PM, PC, and PBk, respectively.

In this embodiment, considering the transferring efficiency with respect to the toner transferred to the exposure part (exposure part potential V1: −150 V), the DC voltage having the positive polarity is applied as a primary transfer bias voltage so as to obtain the transferring current of 8 μA throughout the first color to the fourth color.

Note that, it is also possible to correct the transferring current value depending on the surrounding environment or set the transferring current value for the first color free of the influence of the retransfer to a larger value.

Subsequently, the full color image of the four colors formed on the intermediate transferring belt 91 is collectively transferred onto the transfer material P fed from the transfer material feeding means (not shown) and conveyed at a predetermined timing from a sheet feed roller 12 as the conveying means, by means of the secondary transfer roller 10 as the secondary transfer means.

The transfer material P having the toner image transferred thereonto is subsequently conveyed to a roller fixing device 13 as the fixing means where the toner image is melt-fixed onto the transfer material P by applying the heat and pressure thereto. Following this, the transfer material P is delivered to the outside of the image forming apparatus to obtain the color print image.

The flexible material is undesirable for the intermediate transferring belt 91 if aiming at improving the registration at the image forming sections PY, PM, PC, and PBk of the respective colors. In general, a resin-based belt or a rubber belt including a metal core, and a resin- or rubber-made belt can be used therefor. In this embodiment, the resin belt is used, which is obtained through the carbon dispersion into PI (polyimide) and the control of the volume resistivity to the order of $10^8$ Ωcm. The thickness of the resin belt is 80 μm, and its length in the longitudinal direction and circumference are 390 mm and 900 mm, respectively.

In this embodiment, the one having self-attenuation type electric characteristics is adopted for the intermediate transferring belt 91.

Here, in this embodiment, the term "self-attenuation type" means that, provided that the charge relaxation time is τ (second) and the time required for allowing a part of the intermediate transferring member to move between the two adjacent image bearing members (in other words, between the two adjacent primary transfer parts (transfer means) (T1 to T2, T2 to T3, and T3 to T4) is T (second), the characteristics which can meet the relationship of $\tau \leqq T$ are achieved. On the other hand, the one called a charge-up type does not meet the above condition.

The charge relaxation time X of the intermediate transferring belt 91 is defined on the basis of the time required for allowing the potential V applied at the charging position of the intermediate transferring belt 91 to drop down to V/e (e is a base of the natural logarithm: e=2.718. . . ).

Figure 4:
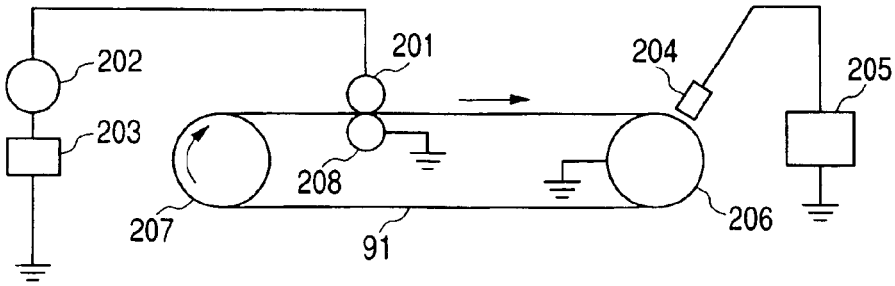
FIG. 4 is a schematic diagram showing a system of measurement for measuring a charge relaxation time for an intermediate transferring member.

Here, the charge relaxation time τ is assumed to be measured by the apparatus shown in FIG. 4. More specifically, the time does not coincide with a value obtained by simply multiplying the capacitance and the resistance of the intermediate transferring belt 91 by each other. Accordingly, in this embodiment, the time measured by the apparatus and method explained by using FIG. 4 is defined as τ.

The intermediate transferring belt 91 is stretched over a drive roller 207 as a measurement jig and a metal tension roller 206, and rotates in the direction of the arrow in FIG. 4 at a speed of 117 mm/sec. The intermediate transferring belt 91 is nipped between a charging roller 201 as the charging means and a metal opposing roller 208 at the charging position and charged with an AC power source 202 having a peak-to-peak voltage Vpp of about 3 kV and a DC power source 203 having a voltage of +500 V.

The environment at the measurement time is set to 23° C. (temperature) and 60% (relative humidity). In addition, the voltage to be applied to the charging roller 201 is set to a voltage corresponding to an absolute value of a difference between the bias of 300 V applied to the primary transfer roller 92 at the time of general image formation under the above environment and the light portion potential of about −200 V in the photosensitive drum 1.

In addition, in this embodiment, the superposed voltage of the DC voltage and the AC voltage is applied to the charging roller 201, so that a portion of the intermediate transferring belt 91 which is brought into abutment with the charging roller 201 is charged to almost the same potential as the above DC voltage (500 V). Note that the peak-to-peak voltage Vpp and the frequency of the AC voltage may be set as appropriate.

The charging roller 201 is of the known contact charge type. For example, on a conductive elastic rubber having a thickness of about 3 mm, an intermediate resistance layer having a thickness of 100 to 200 μm and a volume resistivity of about $10^6$ Ωcm is formed and an adherence preventing layer (nylon-based resin etc.) having a thickness of several tens of μm is further formed on the intermediate resistance layer, thereby achieving a cylinder having a diameter of about 12 mm.

The intermediate transferring belt 91 charged by the charging roller 201 has a surface potential W measured by a surface electrometer probe 204 and an electrometer main body 205. The surface electrometer probe 204 is provided at a position on the downstream side of the charging position. The distance between the position concerned and the charging position is a distance at which the intermediate transferring belt 91 rotates for T seconds. Note that T is assumed to equal the time of 0.8 second required for allowing the part of the intermediate transferring belt 91 to move between the two adjacent image bearing members (photosensitive drums 1) of the image forming apparatus 100 in this embodiment.

At this time, it is concluded that the intermediate transferring belt 91 is, if $W \leqq 500/e$ [V], of the self-attenuation type, whereas the intermediate transferring belt 91 is, if $W > 500/e$ [V], of the charge-up type.

In this embodiment, provided that the time required for allowing the intermediate transferring belt 91 to move from the secondary transfer part T5 to the first primary transfer part T1 (on the most upstream side) is set to T' (second), the relationship of $\tau \leqq T'$ is met. Accordingly, in this embodiment, it is unnecessary to provide a special discharging apparatus for discharging and initializing the intermediate transferring belt 91 after the secondary transfer but before the primary transfer, thereby making it possible to further reduce the size and cost of the image forming apparatus. Similarly, provided that the time required for allowing the intermediate transferring belt 91 to move from the last primary transfer part T4 (on the most downstream side) to the secondary transfer part T5 is set to T" (second), the relationship of $\tau \leqq T''$ is also met.

Also, in this embodiment, in the case where the single-color mode, the two-color mode, and the three-color mode are selected, in order to avoid the electrical deterioration of the photosensitive drum 1 or the mechanical deterioration of the photosensitive drum 1 due to the abrasion with the intermediate transferring belt 91, the intermediate transferring belt 91 and the photosensitive drum 1 not contributing to the image formation may be apart from each other as appropriate.

Note that the constant current power source may be used as the high-voltage power source for the primary transfer and the secondary transfer. Even such a structure enables the reduction in voltage applied to the primary transfer roller and the secondary transfer roller from the power source, so that the control thereof is easy to perform.

In the above case, the roller-shaped primary transfer rollers 92Y to 92K and the secondary transfer roller 10 are used, but a blade-shaped roller or brush-shaped roller can be used instead, to which the present invention is similarly applicable.

Also, the secondary transfer residual toner remaining on the intermediate transferring belt 91 is cleaned by a cleaning blade 11*a* as cleaning means provided in an intermediate transferring belt cleaner 11 to be used for the next image forming step. The cleaning blade 11*a* is set to have a longitudinal length of 330 mm.

Figure 2:
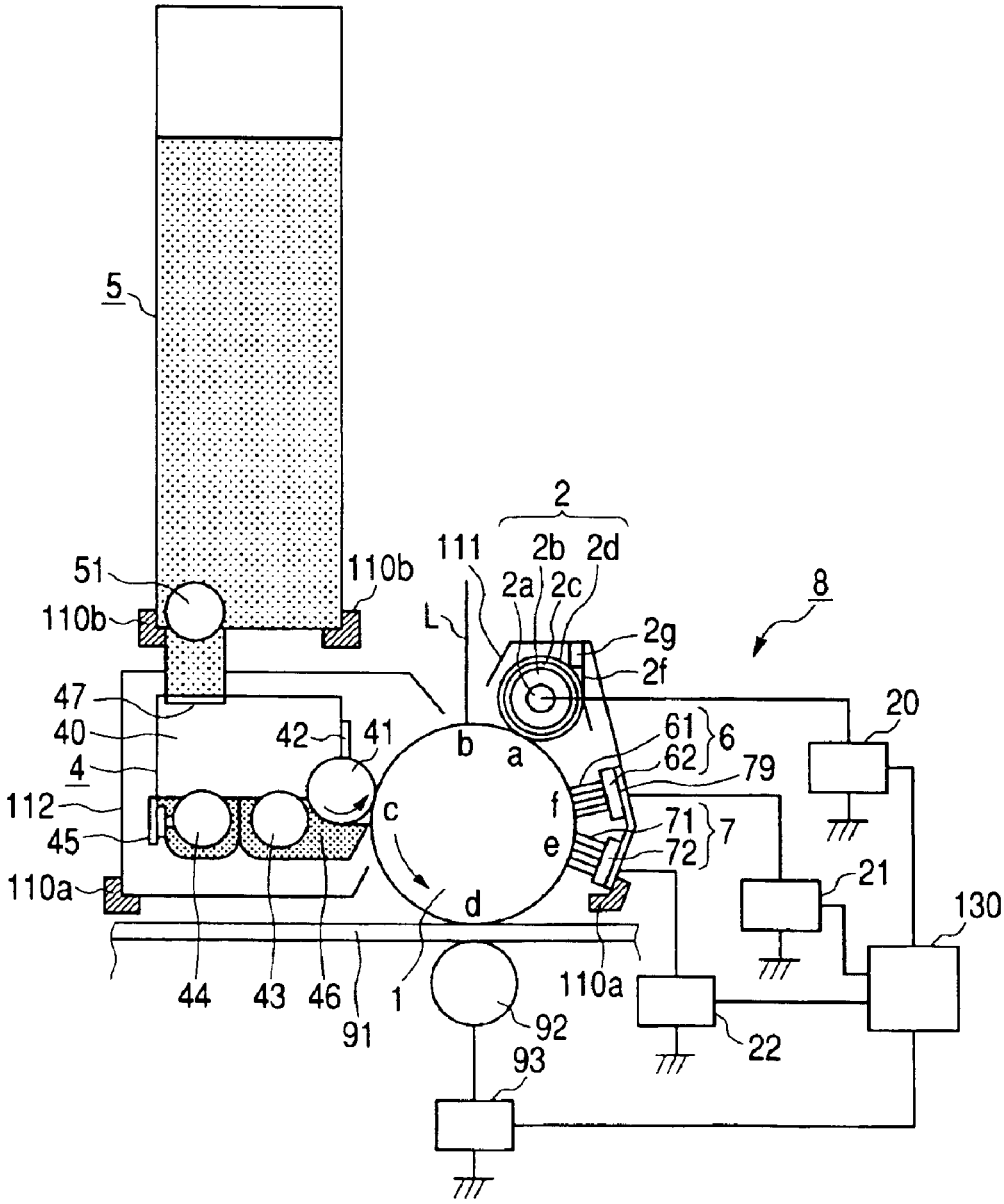
FIG. 2 is a schematic cross-sectional view of a process cartridge to be mounted to the image forming apparatus of FIG. 1.

As shown in FIG. 2, the developer charge amount controlling means 6 and the residual developer uniformizing means 7 are brought into abutment with the photosensitive drum 1, between the transfer part d and the charging part a along the rotation direction of the photosensitive drum 1.

The residual developer uniformizing means 7 and the developer charge amount controlling means 6 are arranged in order from the upstream side in the rotation direction of the photosensitive drum 1 while being located on the downstream side of the transfer part d and on the upstream side of the charging part a in the rotation direction of the photosensitive drum 1. The residual developer uniformizing means 7 and the developer charge amount controlling means 6 form a contact part e and a contact part f with the photosensitive drum 1, respectively.

The transfer residual toner remains on the photosensitive drum 1 surface after the transfer step at the transfer part d and contains negative-polarity toner of the image part, positive-polarity toner of the non-image part, and toner whose polarity is inverted to the positive one by the influence of the positive-polarity voltage for the transfer.

The developer charge amount controlling means 6 is provided for collectively setting the polarities of the transfer residual toner to the negative polarity. In other words, in this embodiment, to the developer charge amount controlling means 6, the DC voltage of the negative polarity that is the same as the regular polarity of the toner is applied from a power source 21 as voltage applying means.

Also, in order to disperse the partially remaining transfer residual toner on the photosensitive drum 1 and a large amount of transfer residual toner thereon, the residual developer uniformizing means 7 is provided. To the residual developer uniformizing means 7, the DC voltage of the positive polarity that is opposite to the regular polarity of the toner is applied from a power source 22 as the voltage applying means. Also, the AC voltage or the AC voltage superposed with the DC voltage may be applied to the residual developer uniformizing means 7.

The negative-polarity charges are highly imparted to the toner on the photosensitive drum 1 by the developer charge amount controlling means 6 and then reduced down to an appropriate charge amount which is collectable by the developing device 4 through the discharging effect owing to the AC voltage applied to the charging roller 2 at the time of causing the toner to pass through the charging part a. Then, the toner after passing through the charging part a is removed from the photosensitive drum 1 surface through the cleaning simultaneous with developing at the developing device 4.

In this embodiment, both the developer charge amount controlling means 6 and the residual developer uniformizing means 7 are constituted of a brush member made of conductive fibers. More specifically, the developer charge amount controlling means 6 has a brush part 61 equipped to a horizontal electrode plate 62. Also, the residual developer uniformizing means 7 similarly has a brush part 71 equipped to a horizontal electrode plate 72. Then, the brush part 61 and the brush part 71 are brought into abutment with the photosensitive drum 1 surface to arrange both the means in a fixed and supported state in substantially parallel with the longitudinal direction of the photosensitive drum 1 (direction substantially perpendicular to the surface movement direction).

The brush part 61 of the developer charge amount controlling means 6 and the brush part 71 of the residual developer uniformizing means 7 are controlled in resistance value such that rayon fiber, acrylic fiber, polyester fiber, etc. contain the carbon or metal powder. The brush part 61 and the brush part 71 preferably have a thickness of 30 deniers or less and a density of 1 to 500,000 fibers per inch$^2$ or more in order to uniformly contact the surface of the photosensitive drum 1 and the residual toner. In this embodiment, it is assumed that the brush part 61 and the brush part 71 both have a thickness of 6 deniers, a density of 100,000 fibers per inch$^2$, a length of the bristle of 5 mm, and a volume resistivity of the brush of $6 \times 10^3$ Ωcm.

The developer charge amount controlling means 6 and the residual developer uniformizing means 7 are arranged in substantially parallel with the longitudinal direction of the photosensitive drum 1 and fixed to a support member 79 reciprocating by a given amount with respect to the above longitudinal direction, and arranged such that the brush part 61 and the brush part 71 come into abutment with the photosensitive drum 1 surface with a penetration amount of 1 mm and an abutment nip part width of 5 mm. The support member 79 reciprocates by a given amount with respect to the longitudinal direction through the gear train by the drive motor of the image forming apparatus 100. With this operation, the photosensitive drum 1 surface rubs against the brush part 61 and the brush part 71 of the developer charge amount controlling means 6 and the residual developer uniformizing means 7, respectively. In this embodiment, the reciprocation amount is set to 5 mm.

The voltage applying means such as the power sources 20, 21, and 22 equipped to the image forming apparatus 100 and the primary transfer bias power source 93 are controlled by a control circuit 130 as the control means for collectively controlling the apparatus operation provided in the image forming apparatus main body.

Note that in this embodiment, the photosensitive drum 1, the charging roller 2, the charging roller cleaning member 2*f*, the developing device 4, the residual developer uniformizing means 7, the developer charge amount controlling means 6, and the like are integrated into a cartridge to constitute the process cartridge 8 by a charging unit frame member 111, a developing frame member 112, and the like. The process cartridge 8 is detachably attached through the attaching means 110*a* provided to the apparatus main body. Further, in the state where the process cartridge 8 is attached to the image forming apparatus main body, the drive means (not shown) provided to the image forming apparatus main body and the drive power transmitting means on the process cartridge 8 side are connected to put the photosensitive drum 1, the developing device 4, the charging roller 2, and the like into a drivable state. Furthermore, in the state where the process cartridge 8 is attached to the image forming apparatus main body, the various voltage applying means such as the power sources 20, 21, and 22 for applying the bias to the charging roller 2, the developer charge amount controlling means 6, and the residual developer uniformizing means 7, and the power source (not shown) for applying the bias to the developing sleeve 41 are electrically connected to the target through the contact provided to each of the process cartridge 8 side and the image forming apparatus main body side. On the other hand, the toner replenishment unit 5 is detachably attached to the developing device 4 and the image forming apparatus main body through the attaching means 11*b*.

Hereinafter, the relationship between the particle size of the toner used in the developing device 4 and the primary transfer property will be described.

In the replenishment-type two-component developing system for replenishing the toner to the developer containing the toner and the carrier in an amount corresponding to the consumed toner amount for the development, the amount of the toner replenished to the developer largely varies until the service life of the developer expires, depending on the print ratio (image ratio). Needless to say, the larger print ratio causes an increase in the amount of the toner replenished from the developer replenishment unit 5.

Regarding the particle size of the toner consumed at the time of outputting the image, it is desirable that the toner be consumed as uniformly as possible without being limited to a specific particle size. In general, the structure of the developing device 4 or the like is devised to meet the demand. However, the toner with the large particle size is likely to remain in the developing device 4 although remaining in a slight amount. Thus, the mean particle size of the toner tends to increase in accordance with the increase of the number of output images, with the result that the above-mentioned electrostatic cohesion of the toner easily occurs due to the continuous image output.

In other words, as described above, in contrast to the fact that the triboelectrification charge of the negative polarity (negative triboelectricity) of the toner with the small particle size increases due to the continuous image output, the toner with the large particle size is likely to involve the triboelectrification charge of the positive polarity (positive triboelectricity), although the amount of the positive triboelectricity is a slight amount. Therefore, in the conventional toner, if the continuous image output is performed, the toner with the small particle size and the toner with the large particle size electrostatically cause the cohesion. Thus, there is a possibility that the electrostatic cohesion of the toner occurs.

Then, for example, in the image forming apparatus using the intermediate transferring member made of resin as in this embodiment, when the toner causes the electrostatic cohesion in this way, since the intermediate transferring member made of the resin is hard, a gap is generated between the photosensitive member and the intermediate transferring member. As a result, the transfer property is deteriorated.

In this specification, the mean particle size of the toner is obtained by the measuring method using the Coulter counter. That is, as the measuring apparatus, Coulter Counter TA-II or Coulter multisizer (manufactured by Beckman Coulter Co.) is used. The measuring method is as follows. That is, as an electrolyte, primary sodium chloride is used to prepare about 1% Nacl aqueous solution. For example, ISOTON-II (produced by Beckman Coulter Co.) can be employed. Added into 100 to 150 ml of the electrolyte aqueous solution is 0.1 to 5 ml of surfactant as a dispersant, preferably alkylbenzene sulfonate and 2 to 20 mg of measurement sample is further added to the mixture. The electrolyte having the sample suspended therein is subjected to dispersion treatment with an ultrasonic dispersion device for about 1 to 3 minutes. With the above measuring apparatus, using a 100-$\mu$m aperture, the weight particle size of the toner is measured to calculate the weight particle size distribution of the toner. Following this, the proportion of the toner with the above size of 12.7 $\mu$m or larger (Up 127) is obtained based on the weight particle size distribution of the toner according to the present invention. Note that the measurement is performed on the 50,000 toner particles.

As channels, the following 13 channels are used: 2.00 to less than 2.52 $\mu$m; 2.52 to less than 3.17 $\mu$m; 3.17 to less than 4.00 $\mu$m; 4.00 to less than 5.04 $\mu$m; 5.04 to less than 6.35 $\mu$m; 6.35 to less than 8.00 $\mu$m; 8.00 to less than 10.08 $\mu$m; 10.08 to less than 12.70 $\mu$m; 12.70 to less than 16.00 $\mu$m; 16.00 to less than 20.20 $\mu$m; 20.20 to less than 25.40 $\mu$m; 25.40 to less than 32.00 $\mu$m; and 32.00 to less than 40.30 $\mu$m.

The inventors of the present invention have made an experimental research on the relationship between the weight particle size distribution of the toner obtained by the above measurement method and the transfer performance after the continuous image output.

As a result of the extensive studies made by the inventors of the present invention, the inventors of the present invention have found the following. That is, in the case of the toner with the mean particle size of 5 $\mu$m to 10 $\mu$m, the proportion of the toner with the particle size of 12.7 $\mu$m or larger (Up 127) calculated from the weight particle size distribution of the toner is highly correlative to the transfer performance after the continuous image output.

The relationship between the proportion of the toner with the particle size of 12.7 μm or larger (Up 127) calculated from the weight particle size distribution of the toner and the transfer performance after the continuous image output is shown in Table 1. In Table 1, the transfer property is evaluated through the measurement of the primary transferring efficiency value or the visual observation (of the incompletely transferred white-dotted transferred image). In the case where the primary transferring efficiency is 98% or higher or the white-dotted untransferred image cannot be visually observed, the transfer property is evaluated as good (o). In the case where the primary transferring efficiency is 95% or higher and lower than 98% or the white-dotted untransferred image is slightly visually observed, the transfer property is evaluated as slightly bad (Δ). In the case where the primary transferring efficiency is lower than 95% or the incompletely transferred white-dotted image is clearly visually observed, the transfer property is evaluated as bad (x).

TABLE 1

| | Transferring current value (μA) | | | | |
|---|---|---|---|---|---|
| Up127 (%) | 5 | 8 | 10 | 12 | 15 |
| 0.2 | Δ | ○ | ○ | ○ | ○ |
| 0.5 | Δ | ○ | ○ | ○ | ○ |
| 0.8 | Δ | ○ | ○ | ○ | ○ |
| 1.0 | x | Δ | ○ | ○ | ○ |
| 1.5 | x | x | Δ | ○ | ○ |
| 2.0 | x | x | x | Δ | ○ |

As described above, in the structure using the in-line system, the cleanerless system, and the intermediate transferring member system, from the viewpoint of prevention of the color mixture resulting from the retransfer, the transferring current value, with which the transferring efficiency is relatively low, is adopted as the transferring current of the transfer roller 92. That is, from the relationship between the transferring current value, and the retransferring efficiency and the transferring efficiency as shown in FIG. 3, the transferring current value is set, with which the retransfer is avoided and the transferring efficiency can be increased as much as possible.

Figure 3:
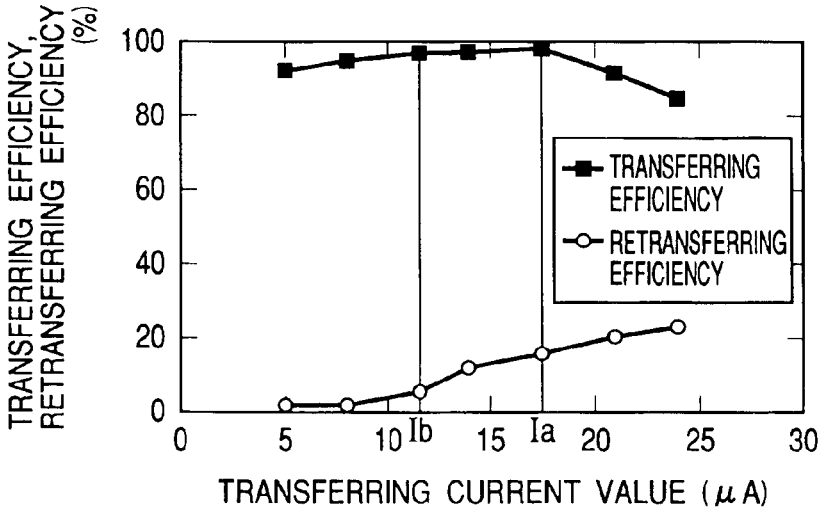
FIG. 3 is an explanatory diagram showing a correlation of a transferring current value with a transferring efficiency and a retransferring efficiency.

For example, in the case where the longitudinal length of the operation part of the transfer roller 92 with respect to the intermediate transferring belt 91 is set to 330 mm in the structure of this embodiment, it is desirable that the transferring current value be set to about 10 μA or lower, preferably about 8 μA or lower (FIG. 3). Note that in the structure of this embodiment, if aiming at increasing the value of the transferring efficiency, the transferring current value is about 10 μA or higher, preferably about 12 μA or higher.

In this embodiment, the transferring current value defined according to the transfer roller 92 is set to 8 μA. Here, the transferring current value may be set to the one corresponding to the unit length if the longitudinal length of the transfer roller 92 varies.

In this way, if the transferring current value is set to the one which involves the slightly low transferring efficiency, up to now, the incomplete transfer has occurred in some cases.

To cope with the above problem, according to the present invention, based on the correlation between the proportion of the toner having the particle size of 12.7 μm or larger (Up 127) calculated from the weight particle size distribution of the toner in the transfer property after the continuous image output and the transferring current value, which are found as a result of studies on the above problem, the value of Up 127 is set.

In other words, referring to Table 1, in the case of the transferring current value being 8 μA, the proportion of the toner having the particle size of 12.7 μm or larger (Up 127) calculated from the weight particle size distribution of the toner may be set to 1.0% or less, preferably 0.8% or less. The rule regarding the toner proportion is applied to new toner before use. Note that the toner having the particle size of 12.7 μm or larger calculated from the weight particle size distribution of the toner is preferably removed while taking into account the cost increase upon the production.

Further, in the replenishment-type two-component developing system, as the toner initially charged in the developing device 4 and in addition, the toner charged in the toner replenishment unit 5 and replenished to the developing device 4 (inclusive of the case of being replenished together with the carrier), the toner whose value of Up 127 falls within the above range is used.

As described above, the value of Up 127 is set within the predetermined range in relation to the transferring current value which is set for avoiding the retransfer and setting the transferring efficiency as high as possible, so that the retransfer can be avoided while the primary transfer property can be kept.

The control of the value of Up 127 of the toner can be performed through, for example, air classification and sieve classification, although not limited thereto. Such a classification method itself would be well known by those skilled in the art, so that the detailed description thereof is omitted here.

As described above, according to this embodiment, in the structure using the in-line system, the cleanerless system, and the intermediate transferring member system, regarding the coarse powder amount of the toner, the proportion of the toner having the particle size of 12.7 μm or larger calculated from the weight particle size distribution of the toner is set to 1.0% or less, preferably 0.8% or less. Therefore, the electrostatic cohesion of the toner can be avoided upon the continuous image output. As a result, the toner image on the photosensitive drum 1 can be transferred and fixed onto the intermediate transferring belt 91 even with the relatively small transferring current value.

Note that as described above, among the plural image forming sections, the transferring current value of the image forming section for the first color free of the influence of the retransfer can be set larger than the transferring current values of the other image forming sections. In this case, it is not always necessary that the value of Up 127 is 1.0% or lower for the image forming section for the first color. In other words, among the plural image forming sections arranged in line along the moving direction of the intermediate transferring member, from the viewpoint of the retransfer prevention, it is also possible to apply the present invention only to the image forming sections in which the transferring current value is set such that the transferring efficiency is slightly low, typically, the image forming sections other than the image forming section on the most upstream side in the moving direction of the intermediate transferring member.

Although in the above embodiment, the case of applying the present invention to the toner in the two-component developer has been described, the present invention is not limited thereto but is applicable to the one-component developer (substantially containing only the toner particles (allowed to contain additives etc.)), and the same effects can be obtained.

Also, in the above embodiment, the developer charge amount controlling means 6 and the residual developer uniformizing means 7 constitute the brush-shaped members in a fixed state but may constitute members of any other shapes such as the sheet-shaped member.

Also, the image bearing member may be of a direct injecting charging property, in which the charge injecting layer is formed, with the surface having the volume resistivity of $10^9$ to $10^{14}$ Ωcm. Also in the case where no charge injecting layer is used, for example, the charge transporting layer falls within the above resistance range, the same effects can be obtained. Also, an amorphous silicon photosensitive member can be adopted, in which the volume resistivity of the surface layer is about $10^{13}$ Ωcm.

Further, regarding the flexible contact charging member, in addition to the charging roller, the members with other shapes and materials like a fur brush, felt, cloth, etc. can be used. Also, the various members with different materials are used in combination to obtain the one having the more appropriate elasticity, surface property, and durability as well.

Also, a waveform of an alternating voltage component (AC component: voltage having a voltage value periodically changed) of an oscillation electric field applied to the contact charging member and the developing member may take a sine waveform, a rectangular waveform, a triangular waveform, etc., as appropriate. It is possible to adopt the rectangular waveform obtained by periodically turning the DC power source ON/OFF.

In addition, the image exposure means as the information writing means to the charged surface of the photosensitive member as the image bearing member may be, for example, digital exposure means using a solid light emitting device array such as an LED other than the laser scanning means in the embodiment. It is possible to adopt image exposure means in an analog manner using a halogen lamp or fluorescent lamp as an original illumination light source. In short, any exposure means can be adopted as long as the electrostatic latent image corresponding to the image information can be formed.

As described above, according to the present invention, the proportion of the toner with the particle size of 12.7 μm or larger calculated from the weight particle size distribution of the toner used in the developing means is regulated to 1.0% or lower, whereby the electrostatic cohesion of the toner due to the continuous image output etc. can be avoided. Accordingly, the toner image on the image bearing member can be transferred and fixed (primarily transferred) even with the relatively small transferring current value. As a result, even in the case of adopting the in-line system, the cleanerless system, and the intermediate transferring member system, the color tint variation due to the retransfer can be suppressed to the minimum level while achieving the primary transfer performance.

What is claimed is:

1. An image forming apparatus, comprising:

a plurality of image forming means each including:

an image bearing member; and developing means for developing an electrostatic image formed on the image bearing member by use of toner, the developing means being capable of collecting residual toner on the image bearing member; and a transfer member provided to be able to contact the plurality of image bearing members, the transfer member being made of a resin material, wherein the toner used in at least one of the plurality of developing means contains a toner particle group with a particle size of 12.7 μm or more, wherein a ratio of the toner particle group to the entire toner being 1.0% or less in a weight particle size distribution, wherein the transfer member is an intermediate transferring member onto which a toner image is transferred from each of the plurality of image bearing members, and wherein the toner image on the intermediate transferring member is transferred onto a transfer material.

2. An image forming apparatus according to claim 1, wherein the toner contains the toner particle group with a particle size of 12.7 μm or more, a ratio of the toner particle group to the entire toner being 0.8% or less in a weight particle size distribution.

3. An image forming apparatus according to claim 1, wherein each of the developing means is capable of performing a collecting operation for collecting the residual toner on the image bearing member simultaneously with a developing operation.

4. An image forming apparatus according to claim 1, further comprising transfer means for transferring the toner image onto the intermediate transferring member from each of the plurality of image bearing members.

5. An image forming apparatus according to claim 4, wherein provided that a time required for the intermediate transferring member to move from a certain transfer position to a next transfer position is represented as T, and a charge relaxation time required for a potential of the intermediate transferring member charged at a potential V to be reduced to V/e (where e is a base of natural logarithm) is represented as τ, $\tau \leqq T$ is satisfied.

6. An image forming apparatus according to claim 4, wherein a transferring current supplied to the transfer means is 10 μA or less.

7. An image forming apparatus according to claim 4, wherein a transferring current supplied to the transfer means is 8 μA or less.

8. An image forming apparatus according to claim 4, further comprising a cleaning member for cleaning the residual toner on the intermediate transferring member, wherein a transferring current supplied to the transfer means is larger in a transfer position of one of the plurality of image forming means which first transfers the toner image onto the intermediate transferring member than in a transfer position of another of the plurality of image forming means.

9. An image forming apparatus comprising:

a plurality of image forming means each including:

an image bearing member; and developing means for developing an electrostatic image formed on the image bearing member by use of toner, the developing means being capable of collecting residual toner on the image bearing member; and a transfer member provided to be able to contact the plurality of image bearing members, the transfer member being made of a resin material, wherein the toner used in at least one of the plurality of developing means contains a toner particle group with a particle size of 12.7 μm or more, wherein a ratio of the toner particle group to the entire toner being 1.0% or less in a weight particle size distribution, and wherein the toner image in a different color is formed in each of the plurality of image forming means.

10. An image forming apparatus according to any one of claims 1 to 3 and 4 to 9, wherein the toner has a mean particle size of 5 to 10 μm.

11. An image forming apparatus according to any one of claims 1 to 3 and 4 to 9, wherein the toner has a mean particle size of 6 to 9 μm.

12. An image forming apparatus, comprising:

an image bearing member; and developing means for developing an electrostatic image formed on the image bearing member by use of toner; and a transfer member provided to be able to contact the image bearing member, the transfer member being made of a resin material, wherein the toner used in the developing means contains a toner particle group with a particle size of 12.7 μm or more, wherein a ratio of the toner particle group to the entire toner being 1.0% or less in a weight particle size distribution, wherein the transfer member is an intermediate transferring member onto which a toner image is transferred from the image bearing member, and wherein the toner image on the intermediate transferring member is transferred onto a transfer material.

13. An image forming apparatus according to claim 12, wherein the toner contains a toner particle group with a particle size of 12.7 μm or more, and wherein a ratio of the toner particle group to the entire toner being 0.8% or less in the weight particle size distribution.

14. An image forming apparatus according to claim 12, wherein a transferring current supplied to the transfer means is 10 μA or less.

15. An image forming apparatus according to claim 12, wherein a transferring current supplied to the transfer means is 8 μA or less.

16. An image forming apparatus according to any one of claims 12 to 15, wherein the toner has a mean particle size of 5 to 10 μm.

17. An image forming apparatus according to any one of claims 12 to 15, wherein the toner has a mean particle size of 6 to 9 μm.

* * * * *

UNITED STATES PATENT AND TRADEMARK OFFICE

CERTIFICATE OF CORRECTION

PATENT NO. : 6,904,251 B2
APPLICATION NO. : 10/693860
DATED : June 7, 2005
INVENTOR(S) : Masao Uyama et al.

It is certified that error appears in the above-identified patent and that said Letters Patent is hereby corrected as shown below:

COLUMN 8:

Line 23, "and the" should read --and then--.

COLUMN 10:

Line 21, "time X" should read --time τ--; and
Line 60, "rubber" should read --roller--.

COLUMN 14:

Line 34, "Nacl" should read --NaCl--.

COLUMN 19:

Line 4, "claims 1 to 3 and 4 to 9," should read --claims 1 to 9,--; and
Line 7, "claims 1 to 3 and 4 to 9," should read --claims 1 to 9,--.

Signed and Sealed this

First Day of April, 2008

JON W. DUDAS
*Director of the United States Patent and Trademark Office*